US005344099A

United States Patent [19]

Pittman et al.

[11] Patent Number: 5,344,099

[45] Date of Patent: Sep. 6, 1994

[54] MISSILE BEAMRIDER GUIDANCE USING POLARIZATION-AGILE BEAMS

[75] Inventors: William C. Pittman; Susan D. Terrill, both of Huntsville, Ala.

[73] Assignee: The United States of America as represented by the Secretary of the Army, Washington, D.C.

[21] Appl. No.: 45,144

[22] Filed: Apr. 12, 1993

[51] Int. Cl.[5] ..... F41G 7/26

[52] U.S. Cl. ..... 244/3.13

[58] Field of Search ..... 244/3.13, 3.14, 3.19; 342/188

[56] References Cited

U.S. PATENT DOCUMENTS

| | | | |
|---|---|---|---|
| 4,245,800 | 1/1981 | Henderson | 244/3.13 |
| 4,424,944 | 1/1984 | Wes et al. | 244/3.13 |
| 4,472,717 | 9/1984 | Eaves et al. | 342/159 |
| 4,516,743 | 5/1985 | Sweeney et al. | 244/3.13 |
| 4,710,734 | 12/1987 | Sterns | 333/101 |
| 4,732,349 | 3/1988 | Maurer | 244/3.13 |

OTHER PUBLICATIONS

Cohen et al., "Preliminary Analysis of IPAR Field Performance", IEEE, New York, USA, 122 PP, pp. 37–42, 1984.

M. E. Wallace et al, "Polarization-Agile Antennas", 17th Annual Symposium on USAF Antenna R&D, University of Illinois, Nov. 1967, 6 pages.

*Primary Examiner*—Ian J. Lobo

*Attorney, Agent, or Firm*—Freddie M. Bush; Hugh P. Nicholson

[57] ABSTRACT

This invention is a beam rider system and method that utilizes polarization-agile millimeter beams. Information is spatially encoded in the beams by varying the rate of rotation of the linearly polarized vector of the beams. In one embodiment, information is encoded on a beam that is nutated around a centerline flight path of a missile. In another embodiment, information is encoded on four parallel beams that form a centerline which is the intended flight path of the missile. Receiver means in the flying missile receive and decode information from the beams and use this decoded information to guide the missile to a target.

7 Claims, 8 Drawing Sheets

MISSILE BEAMRIDER GUIDANCE USING POLARIZATION-AGILE BEAMS

DEDICATORY CLAUSE

The invention described herein may be manufactured, used, and licensed by or for the Government for governmental purposes without the payment to us of any royalties thereon.

BACKGROUND OF THE INVENTION

This invention relates to a system for guiding missiles to a target. More particularly, the invention relates to a missile guidance system where the missile is guided to its target by a polarization-agile beam.

Beamrider guidance is used to direct missiles to their targets in several military systems. Basically, a beamrider guidance system uses one or more beams directed into space such that the axis of the beam is directed toward the intended target of a missile. The beam, which may be either millimeter or light, contains a code such that a missile with an appropriate receiver can receive the beam and determine its relative position within the beam. If the missile deviates from the beam axis, aerodynamic surfaces coupled to the receiver are moved to direct the missile back to the axis.

There are various known techniques used in beam guidance. One is to have a single non-nutating beam directed toward the rear of the missile as the missile flies toward a target. Missile movements that cause it to deviate from the axis of the beam are detected by a decrease in amplitude of beam radiation received by the missile. The receiving device can be structured so as to cause the missile to return to the center of the beam axis. U.S. Pat. No. 3,782,667 entitled "Beamrider Missile Guidance Method" issued to Miller et al discloses such a system.

Another known guidance method is a nutating beam that forms conical scanning. The nutation is synchronized with operations in the missile receiver. The receipt of the radiation on the receiver can thus cause the missile to return to the center line axis around which the beam nutates. The Miller et al patent also discloses this method.

A third known method uses four non-nutating parallel beams, with the intended missile path being the axis formed by all four of the beams. Each beam is distinguishable from the others by means of having a unique frequency or some other distinguishing characteristic. The receiver on the rear of the missile operates such as to let the missile know which beam or beams it is flying in when it veers from the center line axis of the corridor that is formed by the four beams. This information allows the missile to adjust its line of flight to return to the axis. U.S. Pat. No. 4,501,399, for "Hybrid Monopulse/Sequential Lobing Beamrider Guidance" issued to Loomis discloses this method.

A primary consideration for all beamrider systems is the nature of the beam being used. Laser beams have a limitation of not being able to penetrate dust or heavy smoke and thus are not well adapted to ground-to-ground battlefield conditions where a lot of dust or smoke is likely to be generated. Likewise, simple millimeter wave beams may be susceptible to electronic countermeasures which would diminish their effectiveness. Thus, it is desirable to use beams that can penetrate dust and smoke, and to be resistant to electronic countermeasures. The present invention exhibits these desirable characteristics.

SUMMARY OF THE INVENTION

Missile beamrider guidance using polarization-agile beams provides a beamrider guidance system which overcomes the limitations of guidance systems that incorporate laser guidance beams or simple millimeter guidance beams. (The region of the electromagnetic spectrum from one centimeter to one millimeter wavelength is defined as the millimeter wave band.) The invention comprises a polarization agile beam or beams, and a line-of-sight fired missile with a receiver which responds to the beams. The guidance is controlled by spatially encoding the polarization agile millimeter wave beams. One method of doing this is to encode a nutating polarization agility guidance beam by varying the rate of rotation of the polarization vector of the beam from the start of a rotation cycle throughout a 360° rotation of the vector. Another method of doing this is to encode four non-nutating, parallel polarization-agile guidance beams making the polarization modulation frequency for each beam different from the modulation frequencies of all other beams.

While polarization-agile beams are, per se, known in the art, there is no known application of spatially encoding polarization-agile beams in a missile guidance system. This invention therefore capitalizes on the advantageous features of polarization-agile waves in the millimeter wave region with frequency agility. In the preferred embodiment, the invention provides the capability to randomly change both the carrier frequency and the polarization modulation frequency of each of the four guidance beams, thus providing a measure of immunity against electronic countermeasures. The implementation of the invention in the millimeter wave region takes advantage of improved atmospheric propagation conditions over those in the optical and infrared region, and the capability to form sharp antenna beams with smaller size antennae than can be achieved in the microwave region, but at some penalty in propagation effects.

DESCRIPTION OF THE PREFERRED EMBODIMENT

Figure 1:
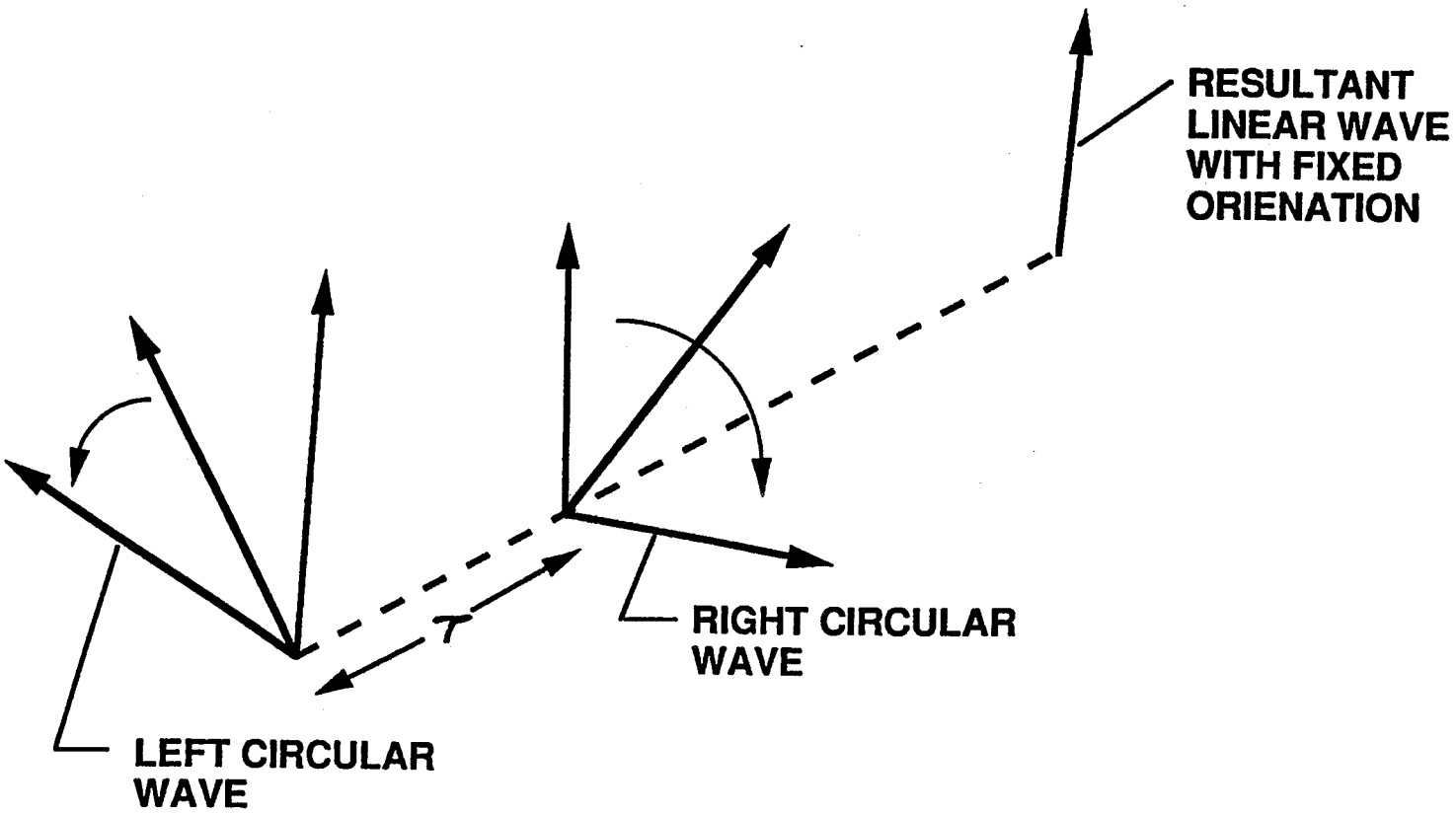
FIGURE 1 PRIOR ART
FIG. 1 is a schematic view of prior art which shows when a right circular wave and a left circular wave are summed, the resultant is a linearly polarized wave with a fixed orientation in space.

Referring now to the drawings, wherein like numbers represent like parts in each of the several figures, FIG. 1 depicts the known phenomenon that when two circularly polarized millimeter waves having equal amplitude and opposite directions of rotation are combined, they will produce a linearly polarized wave. The resultant linearly polarized vector will have a fixed orientation in space when the relative phase between the two circularly polarized waves is fixed. This known phenomenon is discussed in Polarization-Agile Antennas, by Wallace, Zimmer, and Johnson, 17th Annual Symposium on USAF Antenna Research and Development, University of Ill., November, 1967. The orientation of the plane of the linearly polarized vector is determined by the relative phase $\tau$ between the two circularly polarized waves. If a delay is introduced into the relative phase $\tau$ between the circularly polarized waves, the resultant linearly polarized vector will turn in space to a different orientation plane. If the phase delay is varied sinusoidally, the polarization vector will rotate in space at the modulation rate. This rotation of the vector is referred to as "polarization agility", and a beam made up of rotating vectors referred to as "polarization-agile" beams.

Figure 2:
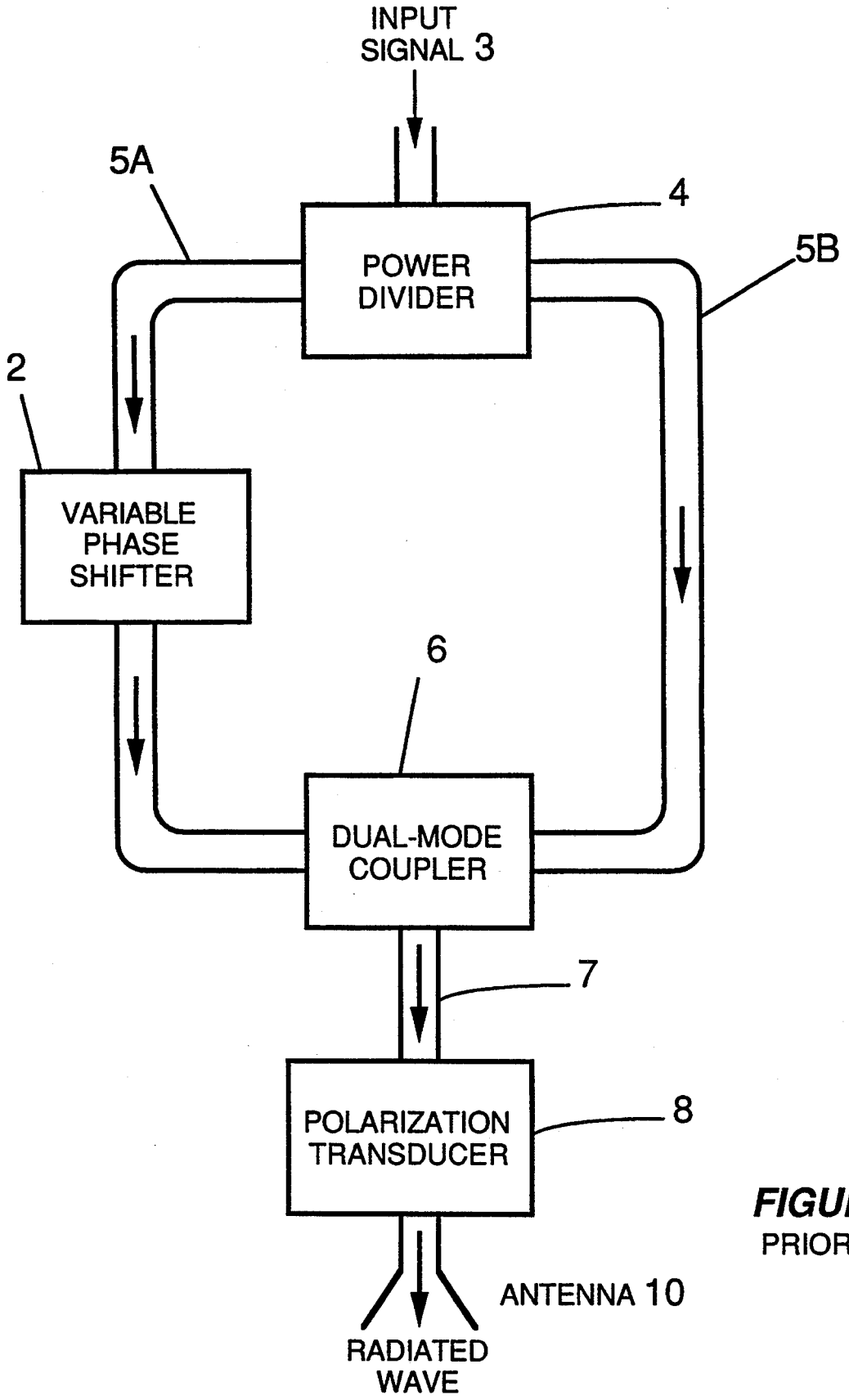
FIGURE 2 PRIOR ART
FIG. 2 is a simplified schematic view of a prior art device for generating a polarization-agile wave.

FIG. 2 illustrates a prior art method of causing a linear polarization vector to rotate in space by means of a variable phase shifter 2, with the rotating linearly polarized wave being transmitted into space as a radiated wave. In the system as shown in FIG. 2, a millimeter wave input signal 3 is divided into two equal paths 5A and 5B by a power divider 4, with one path having the means 2 for introducing a phase delay in the signal. The two signals are then coupled from the two paths 5A and 5B (arms of a rectangular waveguide) into a section of a square waveguide known as a dual-mode coupler 6 that allows simultaneous transmission of the two orthogonal linearly polarized millimeter waves along an output path 7. The combined millimeter waves are introduced to a circular-to-linear polarization transducer 8, then to an antenna 10 to provide a radiated polarization-agile wave. The superposition of two oppositely polarized coaxial circular millimeter waves is a linearly polarized wave. By varying the phase with the variable phase shifter 2 in one arm, the linearly polarized electric field vector is caused to rotate in space as is well known. If the phase is varied non-linearly, the rotation will be at different rates within a 360° rotation of the linearly polarized vector.

Figure 3:
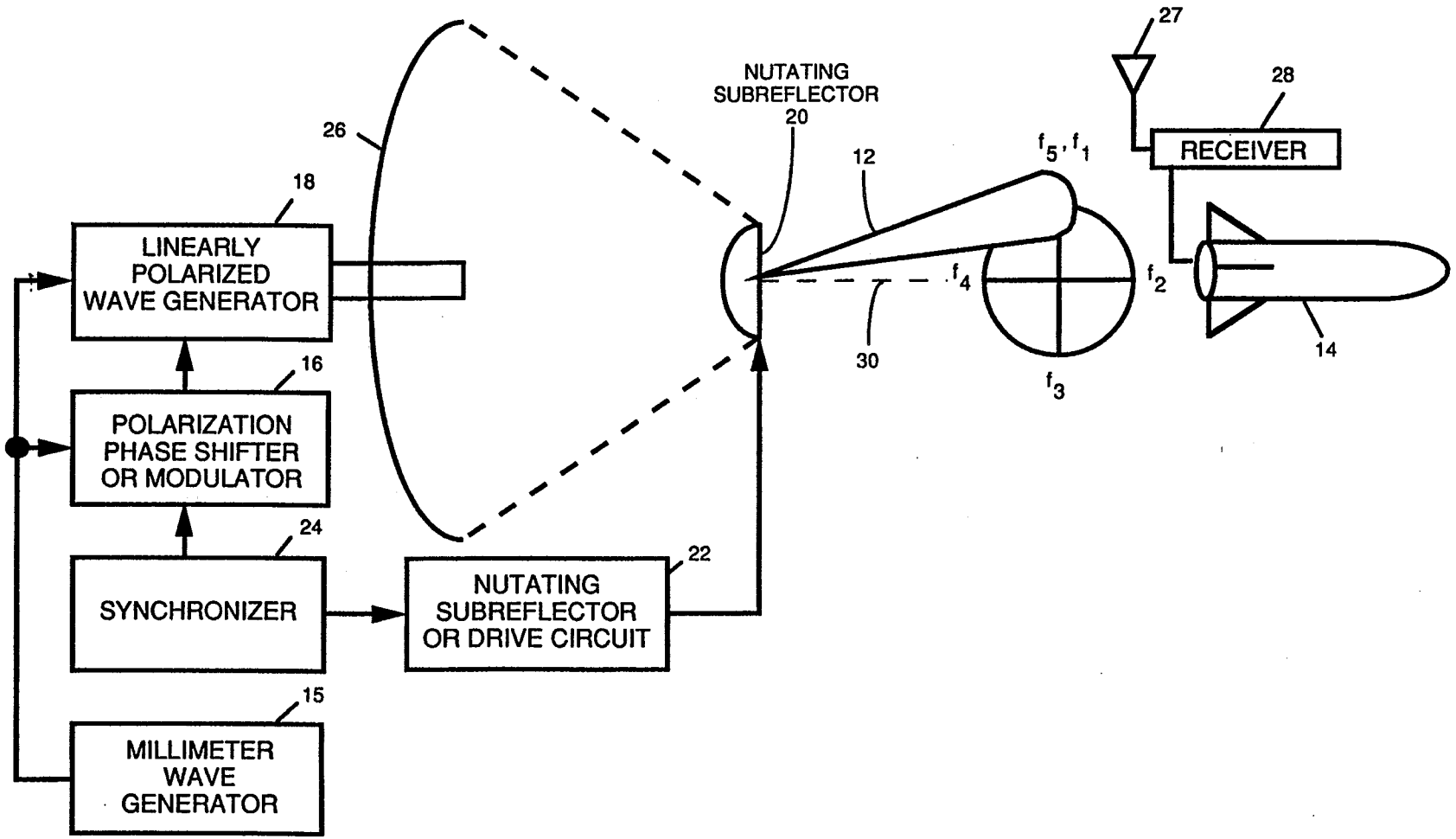
FIG. 3 is a block diagram of an embodiment of the invention, showing a nutating beam application of varying polarization vector rotation rate to spatially encode a millimeter wave beam.
Figure 4:
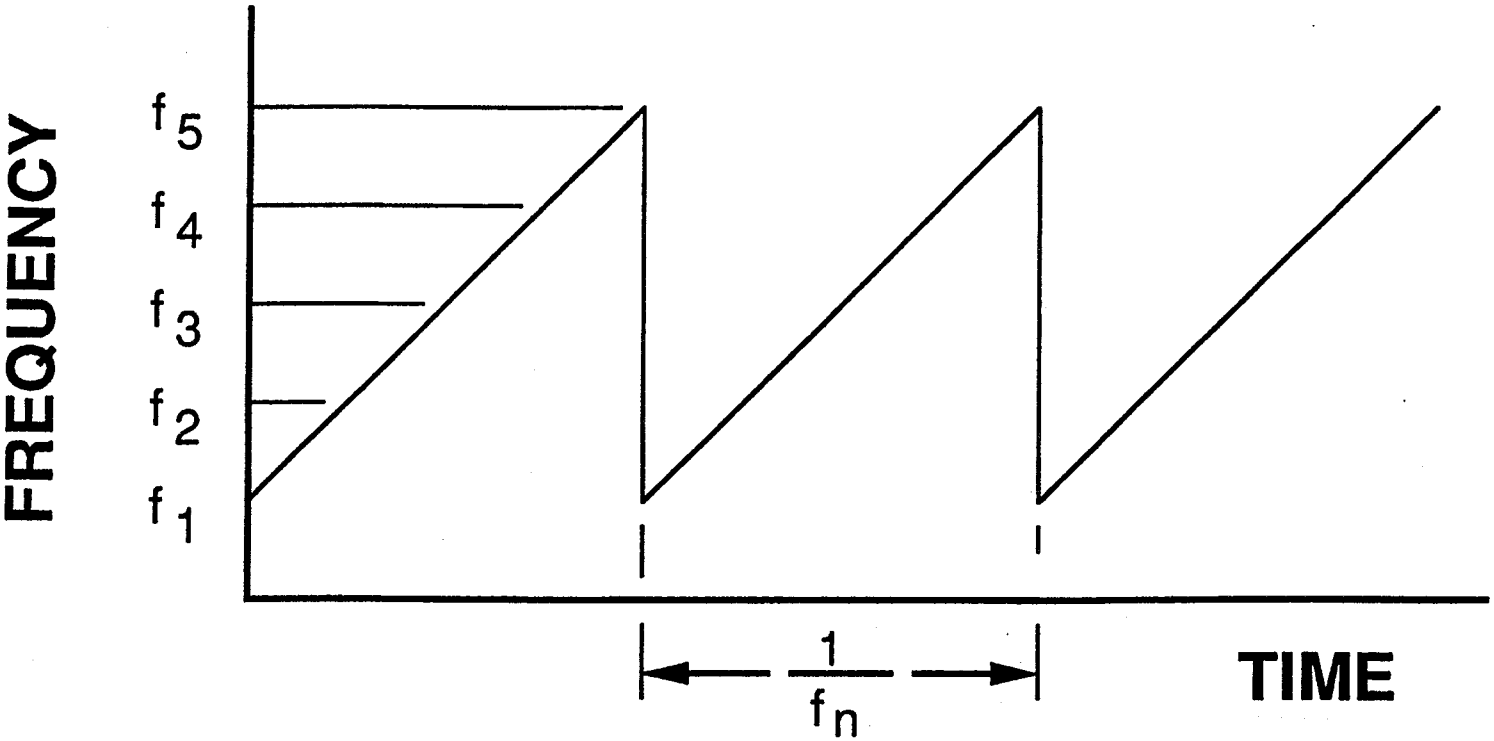
FIG. 4 is a graph which shows a variation of polarization modulation frequency for a nutating beam with respect to time, and the relationship of this modulation frequency with the beam nutation frequency.

FIG. 3 illustrates one embodiment of the invention showing the use of a single nutating polarization-agile beam 12 for guiding a missile 14 that is moving through space. Millimeter wave generator 15 generates an output wave that is coupled to a phase shifter 16 and to a linearly polarized wave generator 18. The variable phase shifter (or modulator) 16 causes the polarized vector of the wave generated by millimeter wave generator 15 to rotate. The rate of rotation goes from $f_1$ to $f_5$ through a 360° rotation of the polarization vector, and at $f_5$ goes back to $f_1$ at the start of a new rotation cycle of the vector (FIG. 4). The wave from the phase shifter 16 goes to the linearly polarized wave generating device 18 for modulating the output therefrom.

A nutating subreflector 20 is modulated by nutating subreflector drive circuit 22 at a frequency $f_n$. The relationship between $f_1$ through $f_5$, and $f_n$ is shown in FIG. 4, wherein $f_5 > f_1 >> f_n$. The change in rotation rate $f_1$ to $f_5$ of the linear vector of the polarization-agile beam 12 is synchronized with the rate of modulation of the nutating subreflector drive 22 by means of a synchronizer 24. The signal generated by the linearly polarized wave generating device 18 is transmitted to the nutating subreflector 20 by means of a parabolic antenna 26. Missile 14, flying in the centerline 30 formed by the nutation of the beam, has a single rearward looking polarized antenna 27 connected to receiver 28 that senses the amplitude of the modulation rate induced by the varying rotation frequency of the polarization vector of the beam and thereby establishes the specific radial of the nutation beam that it is located on. The amplitude of the modulation at a particular polarization vector rotation frequency establishes the distance out from the beam center on the radial, so the missile can establish its position in two coordinates, i.e. the particular radial and the distance out on the radial. From this information, guidance commands are developed to cause the missile to fly down the sight line 30 around which the beam 12 rotates.

Additionally, the rate of rotating the polarization vector of a linearly polarized beam 12 can go from a higher frequency to a lower frequency, and the rotation rate can vary continuously or in discrete steps. Although the rotation rate can vary other than linearly, a linear rate of change is preferred, and best repeatability and stability is achieved by varying the rotation rate in discrete steps by digital control rather than by analog control. Angular resolution capability is improved by increasing the difference between the highest rotation frequency and the lowest.

Figure 5:
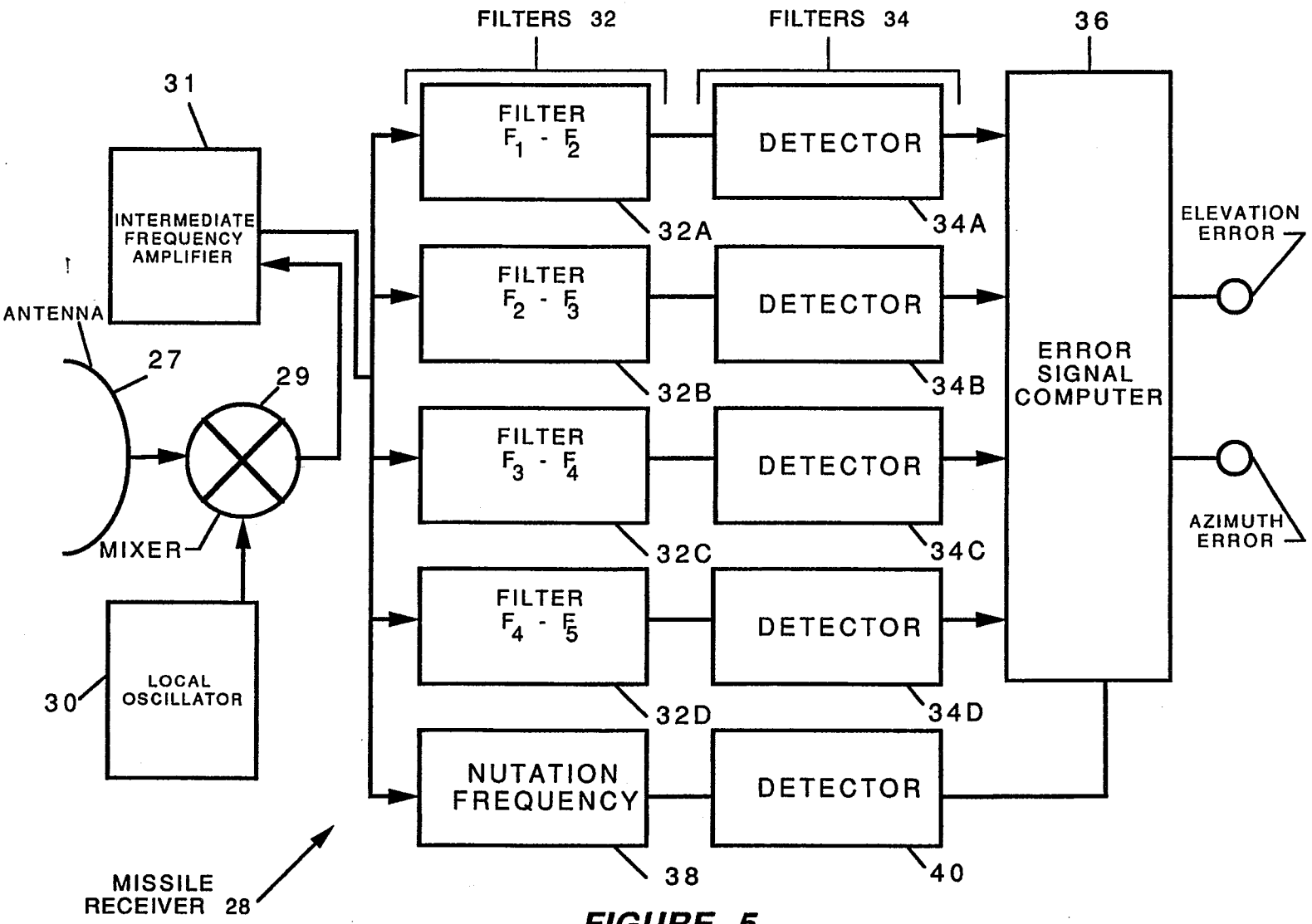
FIG. 5 is a block diagram of a receiver on a missile that operates on received polarization-agile guidance waves for the nutating beam case.

An embodiment of a rearward-looking missile receiver 28 is shown in FIG. 5. A linearly polarized antenna 27 with the polarization vector aligned with either the azimuth or elevation plane of the missile converts the polarization-agile signals to amplitude modulated signals. The incoming amplitude modulated millimeter wave signal is received by antenna 27. Using a mixer 29, this received signal is combined with a signal from local oscillator 30 to obtain a lower intermediate frequency, which is amplified in amplifier 31, filtered in filter bank 32 and detected in detector bank 34. Filter bank 32 is comprised of filters 32A, 32B, 32C, and 32D which are coupled respectively to detector 34A, 34B, 34C, and 34D of detector bank 34. The frequencies in the range $f_1$–$f_2$ that correspond to or define the first quadrant of rotation of the guidance beam 12, as shown in FIG. 3, are filtered (filter 32A) and detected (detector 34A) and the output is applied to an error signal computer 36. The frequencies $f_2$–$f_3$ are likewise filtered and detected to provide an input to the error signal computer for the second quadrant, and frequencies $f_3$–$f_4$ and $f_4$–$f_5$ provide inputs to the error computer for quadrants 3 and 4 respectively. A nutation frequency filter 38 allows the nutation frequency to be coupled to a detector 40. The output of detector 40 is coupled to computer 36 and used in conjunction with the nutation frequencies to provide the azimuth and elevation outputs.

Figure 6:
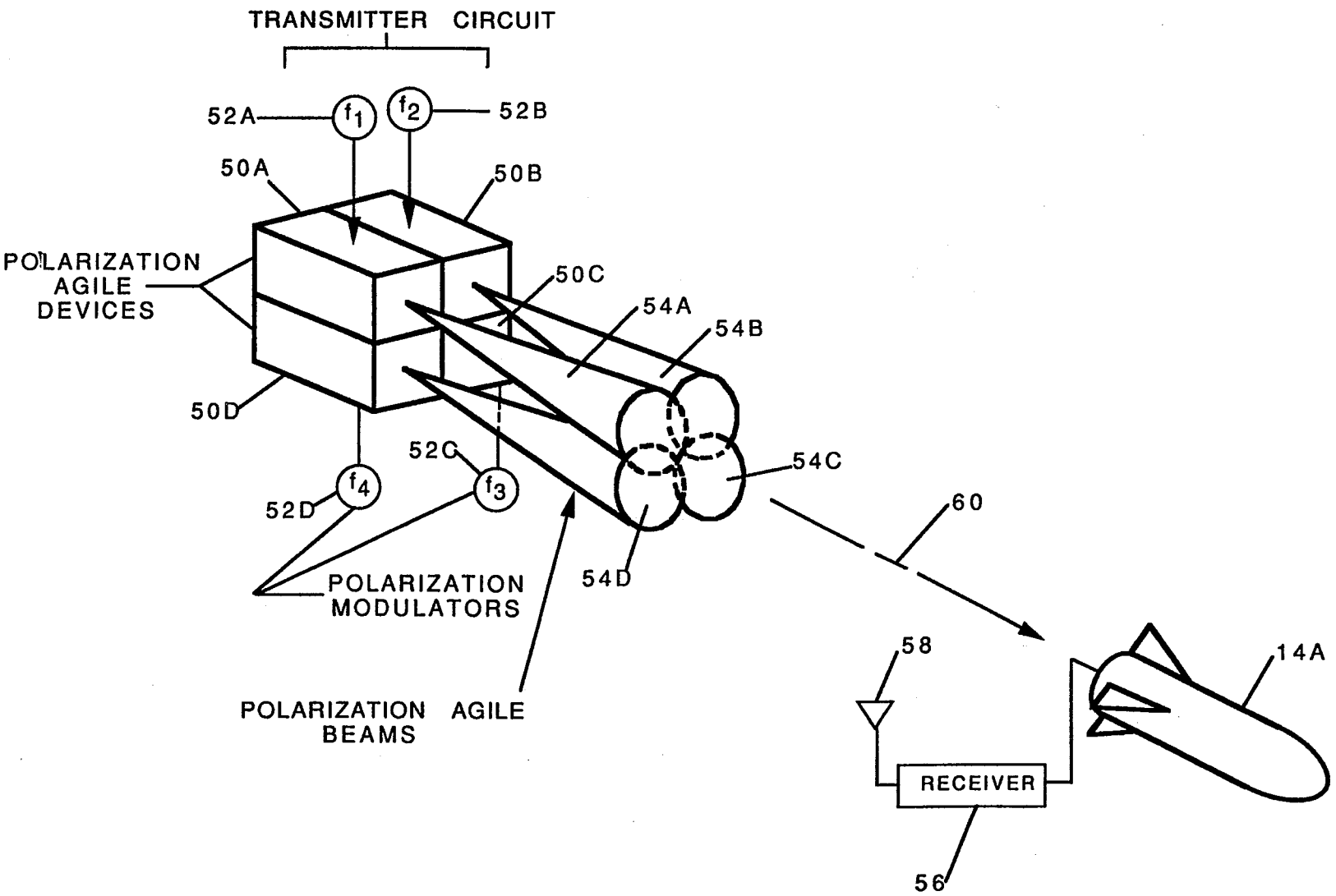
FIG. 6 is a simplified block diagram of another embodiment of the invention, which is a system for guiding a missile with four parallel polarization-agile beams.

The preferred embodiment of the invention is shown in FIG. 6. Instead of the nutating beam as shown in FIG. 3, four polarization agility devices 50A-D are employed to produce a non-nutating four beam system modulated by respective polarization modulators 52A-

D. Each output beam 54A-D has a distinctly different polarization rotation frequency, $f_6$, $f_7$, $f_8$, and $f_9$, separated from each other to allow efficient filtering in a missile borne receiver 56. A missile 14A with a rearward-looking linear antenna 58 and receiver 56 detects and filters all four modulating frequencies. The beams are arranged to overlap in space. Under these conditions, the relative amplitudes of the four modulating linearly polarized agile waves provide coordinate information relative to the center line 60 that is established by the four beams. If the missile is flying down the center line of the four beams, the amplitudes of the four modulation frequencies that are received by receiver 56 are the same, and no commands to the missile are required. The relative amplitudes of the four modulation frequencies which modulate the four respective beams are compared to generate corrective commands that cause the missile to fly down center line 60.

Figure 7:
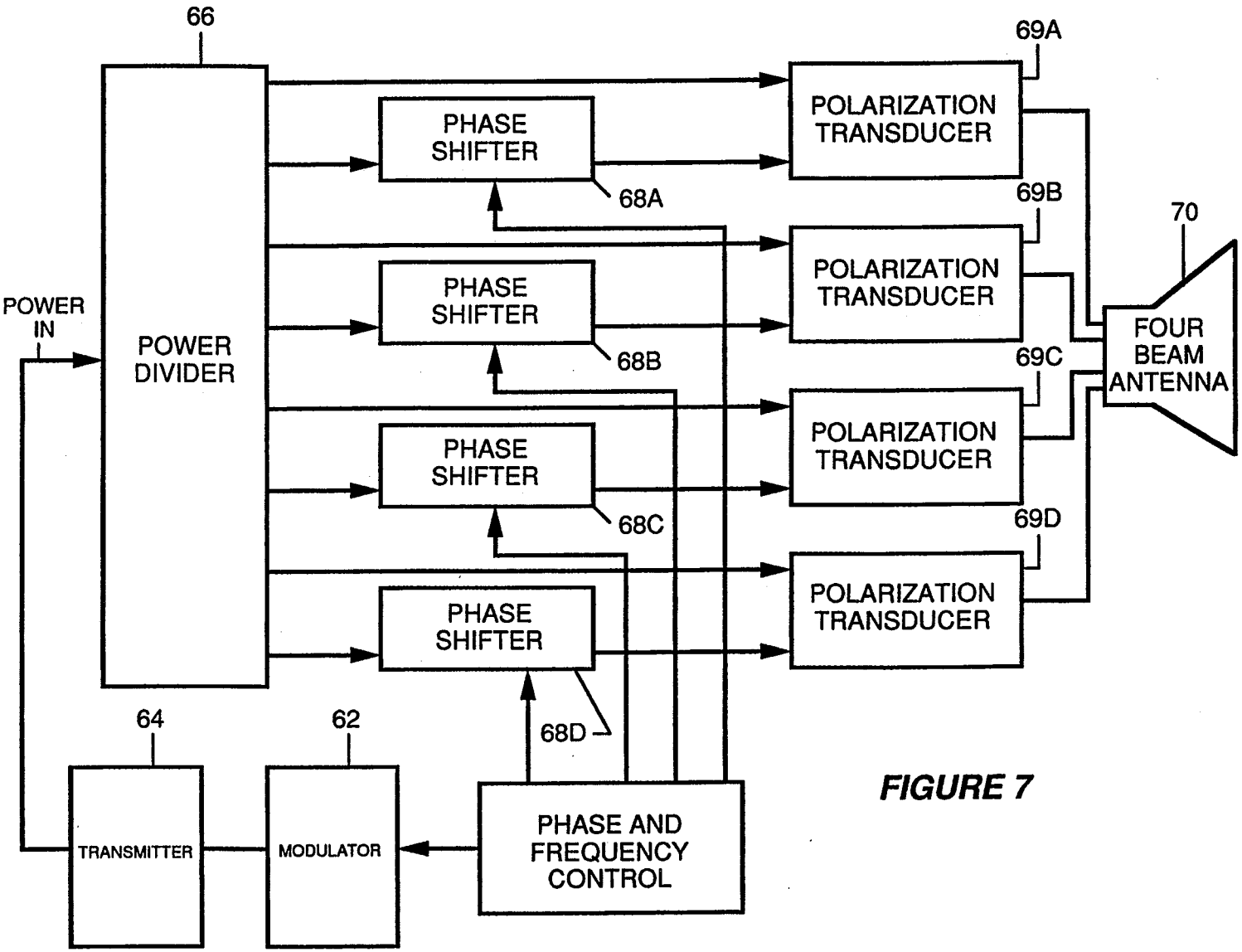
FIG. 7 is a block diagram view of the same system in FIG. 6 for guiding a missile with four parallel polarization-agile beams with frequency agility.
Figure 8:
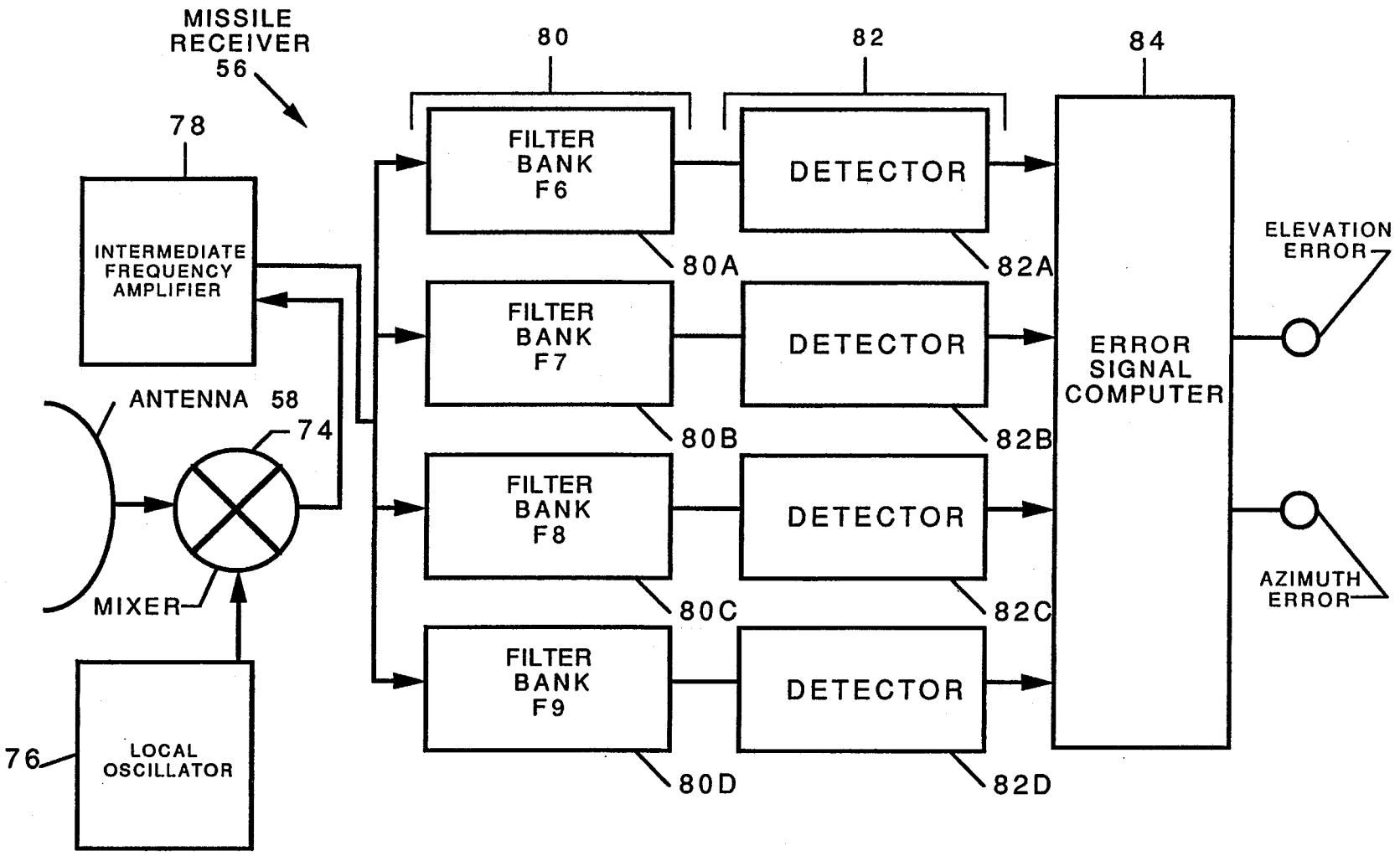
FIG. 8 is a block diagram of a receiver on a missile that operates on a frequency agile—polarization-agile waves for the non-nutating case shown in FIG. 6.

FIGS. 7 and 8 show the respective beam transmitter circuit and receiver circuits from FIG. 6. Each of the four beams, 54A, 54B, 54C, and 54D is generated and detected in a like manner; therefore only the signal processing along one beam path will be discussed in detail. For the polarization agile millimeter wave beam projection or transmitter of FIG. 7, a modulator 62 and transmitter 64 are coupled in series to a power divider 66 which divides output power into two paths associated with each beam. Power is coupled through phase shifter 68A to polarization transducer 69A for one path and is coupled directly to transducer 69A for the second path. An output from transducer 69A is then coupled to four-beam antenna 70 to provide the output beam 54A. Similarly, phase shifters 68B-D and polarization transducers 69B-D provide coupling from divider 66 to antenna 70 to produce beams 54B-D. A phase and frequency control circuit 72 is coupled to modulator 62 and the phase shifters 68, synchronizing power and phase shift.

For the missile receiver 56, antenna 58 receives the four beams as shown in FIG. 8 and mixes the signals in mixer 74 with a local oscillator 76 output to produce an intermediate frequency that is amplified (amplifier 78) and coupled to filter bank 80 to select the respective frequencies $f_6$, $f_7$, $f_8$, and $f_9$. The respective filter bank outputs from the filters are detected in detector bank 82 and the outputs, from the detectors are processed in error signal computer 84 to provide elevation and azimuth output signals to the missile. The local oscillator 76 frequency hops in synchronization with the transmitter to assume accurate mixing of received signals.

The millimeter frequencies that are considered optimum for this invention are 94 Ghz and 140 Ghz. Both of these frequency bands are in atmospheric windows where atmospheric attenuation reaches a minimum, and component and device work essential for implementing this invention has been done in both bands. The invention can be implemented in the 94 Ghz band and take advantage of the more mature device and component technology and more favorable propagation conditions, or in the 140 Ghz band where narrower beams can be formed to reduce multipath effects, but with the penalty of less mature and more lossy components and less favorable atmospheric transmission.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. In a system for directing a beam of energy along a path wherein the beam is modulated to encode guidance signals, a method of spatially encoding a beam of energy with guidance signals to provide a polarization-agile millimeter guidance beam comprising the steps of:

(a) continuously rotating a polarization-agile millimeter guidance beam from 0 degrees through 360 degrees around a straight line between the beam origin and a second point, (b) encoding guidance signals onto said beam by continuously changing the polarization modulation frequency of the guidance beam from a first frequency when the guidance beam is at 0 degrees to a second frequency when the guidance beam is at 360 degrees, and (c) synchronizing beam rotation with the polarization modulation frequency.

2. A method of spatially encoding a millimeter guidance beam as set forth in claim 1 wherein the manner of changing the polarization modulation frequency from a first frequency to a second frequency is linear.

3. A method of spatially encoding a millimeter guidance beam as set forth in claim 1 wherein the manner of changing the polarization modulation frequency from a first frequency to a second frequency is by discrete steps.

4. A method of spatially encoding a millimeter guidance beam as set forth in claim 1 wherein the manner of changing the polarization modulation frequency from a first frequency to a second frequency is exponential.

5. A method of spatially encoding polarization-agile millimeter guidance beams comprising the steps of:

(a) emitting four discrete parallel polarization agile millimeters guidance beams, and (b) modulating each of the four parallel polarization agile millimeters guidance beams with a distinct polarization rotation frequency and independently controlling the respective guidance beams.

6. A system for guiding a missile during its flight through space by a polarization-agile millimeter wave beam comprising:

a) generator means for generating a polarization-agile millimeter wave beam having a linearly polarized vector;

b) means coupled to said generator means for varying the rotation rate of the linearly polarized vector of said polarization-agile millimeter wave beam through a 360° rotation of the vector;

c) transmitting and nutating means coupled to said generator means for transmitting said wave beam into space, and nutating said wave beam around a line-of-sight centerline emanating from said transmitting and nutating means;

d) means for synchronizing said varying rotation rate of said linearly polarized vector with said nutation of said transmitted wave beam;

e) a missile flying substantially along ja centerline; and f) means on said missile for receiving said nutating beam and directing the flight of said missile through space along said line-of-sight centerline in accordance with spatially encoded information received from said nutating beam.

7. A system for guiding a missile during its flight through space by a polarization-agile millimeter wave beam comprising:

a) means for generating and transmitting into space four parallel polarization-agile millimeter wave beams;

b) means for rotating the polarization vector of each of said millimeter wave beams at a rotation rate different from each other to spatially encode said beams;

c) means on a flying missile for receiving said millimeter wave beams and directing the flight of said missile through space toward a target in accordance with spatially encoded information received from said beams.

* * * * *